United States Patent [19]

Streich et al.

[11] Patent Number: 4,982,060

[45] Date of Patent: Jan. 1, 1991

[54] CONTACT ARRANGEMENT FOR AN ELECTRIC SWITCHING APPARATUS

[75] Inventors: Georg Streich, Amberg; Guenter Gnahn, Sulzbach-Rosenberg, both of Fed. Rep. of Germany

[73] Assignee: Siemens Aktiengesellschaft, Berlin & Munich, Fed. Rep. of Germany

[21] Appl. No.: 336,694

[22] Filed: Apr. 12, 1989

[30] Foreign Application Priority Data

May 3, 1988 [DE] Fed. Rep. of Germany ..... 8805875

[51] Int. Cl.[5] ..... H01H 1/20

[52] U.S. Cl. ..... 200/243; 200/281; 200/275

[58] Field of Search ..... 200/243, 275, 250, 280, 200/281; 335/131, 132, 130

[56] References Cited

U.S. PATENT DOCUMENTS

| | | | |
|---|---|---|---|
| 4,262,179 | 4/1981 | Bauer | 200/243 |
| 4,453,057 | 6/1984 | Streich et al. | 200/243 |
| 4,634,819 | 1/1987 | Ikeda | 200/16 A |
| 4,650,935 | 3/1987 | Ootsuka et al. | 200/243 |
| 4,746,779 | 5/1988 | Drexler et al. | 200/243 |

FOREIGN PATENT DOCUMENTS

| | | | |
|---|---|---|---|
| 0074575 | 3/1983 | European Pat. Off. . | |
| 2253918 | 5/1976 | Fed. Rep. of Germany . | |
| 3136354 | 3/1983 | Fed. Rep. of Germany . | |
| 3326427 | 2/1985 | Fed. Rep. of Germany | 200/243 |
| 2205724 | 5/1974 | France . | |

*Primary Examiner*—Henry J. Recla
*Assistant Examiner*—Glenn T. Barrett
*Attorney, Agent, or Firm*—Kenyon & Kenyon

[57] ABSTRACT

A contact arrangement for an electromagnetic switching apparatus having parallel offset contact bridges which are held in windows of a contact bridge carrier. These contact bridges are prevented from shifting transversely to the direction of force of a contact pressure spring pushing against a spring cup. The contact bridges are connectable to fixed contact parts. The spring cup is adapted to the offset of the contact bridges and has a separating rib for the contact bridges which extends between the two parallel contact bridges, so that mutual contact of the contact bridges with each other is impossible if diagonally opposite contact parts are welded together when the contacts are opened.

8 Claims, 1 Drawing Sheet

CONTACT ARRANGEMENT FOR AN ELECTRIC SWITCHING APPARATUS

FIELD OF THE INVENTION

The present invention relates to electromagnetic switching apparatus, with a contact arrangement of parallel offset contact bridges which are held in the windows of a contact bridge carrier via a spring cup. The contact bridges are held against movement transverse to the direction of motion of the spring cup by the force of a contact pressure spring. The contact bridges are connectable to fixed contact parts.

BACKGROUND OF THE INVENTION

In a known contact arrangement of the above kind described in German Published Unexamined patent application No. 31 36 354, the parallel contact bridges lie closely together in the vicinity of a spring cup and contact overlays. As a result, if diagonally opposite contact overlays of different contact bridges are welded together with the fixed contact parts when the contact arrangement is opened in a scissor manner, a connection of the fixed contact parts can remain via the central parts of the contact bridges.

A more reliable opening for unfavorable welding conditions when using double contact bridges was described by German Patent No. 22 53 918. However, in that known arrangement, the contact area is not fully utilized due to the relatively large spacing of the two contact bridges from each other. Furthermore, the known arrangement is not suitable for automatic production due to the lateral introduction of the cocked contact bridges into slots of the spring cup. In other words, the contact bridges cannot be inserted in the longitudinal direction. In addition, the mobility of the contact bridges relative to each other is only limited.

SUMMARY OF THE INVENTION

The present invention overcomes the deficiencies noted above by providing a contact arrangement for an electromagnetic switching apparatus that has a contact bridge carrier having windows and a spring cup arranged in these windows. Parallel offset contact bridges are held in the windows by the spring cup and are connectable to contact parts. A contact pressure spring is coupled to the spring cup. This contact pressure spring provides a force on the spring cup to hold the parallel offset contact bridges and prevent movement of the parallel offset contact bridges in a direction transverse to the direction of this force. The spring cup is made of insulating material, and is adapted to the offset of the parallel offset contact bridges. The spring cup includes a separating rib which protrudes between the parallel contact bridges when the bridges are in an inserted condition in these windows.

In order to keep the contact bridges reliably spaced even if they are crossed over in an extreme manner, an embodiment of the present invention provides that the separating rib extends over the entire outer contour of the spring cup. In certain embodiments of the invention, the contact bridge carrier has recesses matched to the separating rib in the small window boundary walls. This is so that the spring cups come fully into contact with the walls of the windows of the contact bridge carriers and to make possible insertion of the contact bridges between the spring cup and the window by automatic machinery. In certain embodiments, in order for the material of the contact overlays of the window contact parts to be utilized fully, i.e., the contact overlays of the adjacent contact bridges being as close together as possible which precludes shifting of the contact bridges relative to each other in a normal position, the contact bridges are made wider in the vicinity of the contact overlays.

In some embodiments of the invention, a pair of contact bridges have matching extensions and recesses. The pair of contact bridges can be inserted into the contact bridge carrier only in a correct position because of these extensions. If the extensions and recesses are located with mirror symmetry on a longitudinal side of the contact bridge to the center of the contact bridge, the adjacent contact bridges can be designed completely identical.

DETAILED DESCRIPTION

Figure 1:
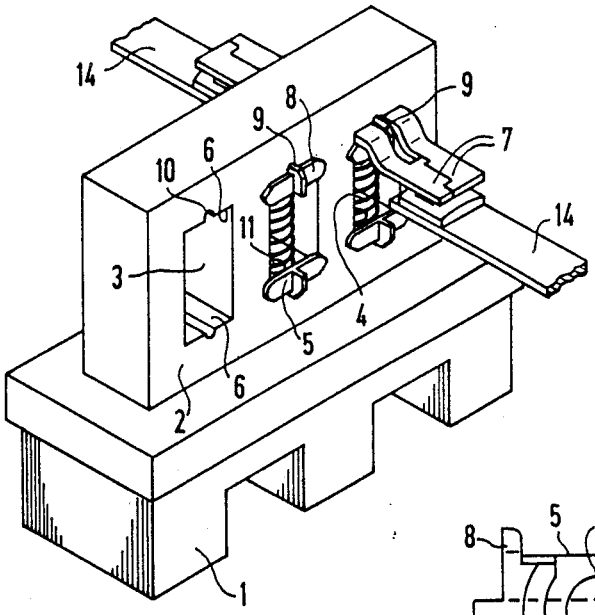
FIG. 1 is a perspective view of a contact bridge carrier with an inserted contact bridge constructed in accordance with an embodiment of the present invention.
Figure 4:
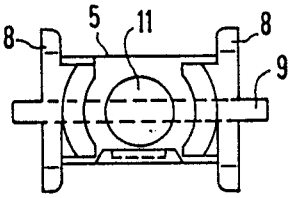
FIG. 4 is a bottom view of the spring cup of FIG. 2 constructed in accordance with an embodiment of the present invention.
Figure 2:
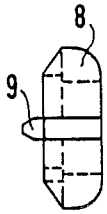
FIG. 2 is a front view of a spring cup constructed in accordance with an embodiment of the present invention.

An electromagnetic switching apparatus is shown in FIG. 1 that has a switching magnet part 1 fastened to a contact bridge carrier 2. This contact bridge carrier 2 is made of an insulating material, such as plastic. In the contact bridge carrier 2, window-like openings (hereinafter windows) 3 are provided in which the spring cups 5 movable in the windows 3 are guided against the force of a contact pressure spring 4. Under the force of the pressure spring 4, the spring cup 5 rests against narrow boundary walls 6 of the windows 3.

Figure 3:
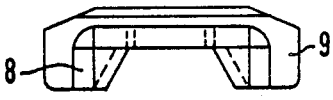
FIG. 3 is a side view of the spring cup of FIG. 2 constructed in accordance with an embodiment of the present invention.
Figure 6:
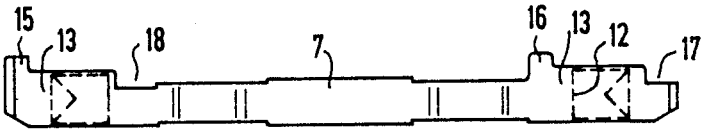
FIG. 6 is a top view of the contact bridge of FIG. 5.
Figure 5:
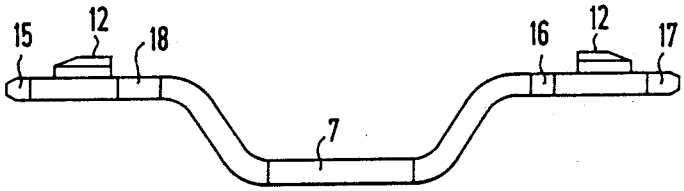
FIG. 5 is a front view of a contact bridge constructed in accordance with an embodiment of the present invention.

The spring cups 5 are adapted, as shown in FIG. 3, to the offset of contact bridges 7 and have guiding extensions 8 which extend beyond the windows 3. The spring cups 5 also have ribs 9 which, when the contact bridges 7 are inserted, protrude between the two contact bridges 7. This is shown in the right-hand window 3 of the arrangement according to FIG. 1.

If the contact bridges 7 are not inserted, the separating ribs 9 protrude into correspondingly matched slots 10 at the narrow window boundary walls 6, so that the spring cup 5 rests flush on these boundary walls 6. The contact pressure spring 4 provides the force which causes the spring cup 5 to contact the boundary walls 6. For bracing the spring, plastic guiding posts 11 are formed on the inside of the spring cup 5.

In the area of contact overlays 12, the contact bridges 7 have enlargements 13 so that the entire area of the contact overlays 12 can be utilized for contacting the fixed contact parts 14. These fixed contact parts 14 are only partially shown in FIG. 1. The space between two contact bridges 7 is left free for the separating rib 9. In the area of the enlargements 13, extensions 15 and 16 are formed which can protrude into corresponding recesses 17 and 18, respectively, of the opposite contact bridge. This provides that the two contact bridges 7 can be inserted only in one direction between the spring cup 5 and the window boundary wall 6, leaving the space for the separating rib 9 free. If the contact bridges 7 were put together along their non-enlarged sides, the extensions 15 and 16 would prevent insertion into the windows 6. The serration of extensions 15, 16 and recesses 17, 18 also makes shifting of the individual contact bridges relative to each other in the longitudinal direction substantially impossible in operation. In addition, insertion by a machine is facilitated substantially by the fact that the two contact bridges 7 are inserted in only one direction between the spring cup 5 and the window boundary wall 6.

What is claimed is:

1. A contact arrangement for an electromagnetic switching apparatus, comprising:

a contact bridge carrier having windows;

a spring cup arranged in one of said windows;

parallel offset contact bridges that are held in said window by said spring cup and which are connectable to separate contact parts, said parallel offset contact bridges each having end portions and a center portion offset from said end portions; and a contact pressure spring coupled to said spring cup, said contact pressure spring providing a force on said spring cup to hold said parallel offset contact bridges in a direction transverse to the direction of said force;

wherein the spring cup is made of insulating material, and includes a surface having an outer contour adapted to the offset of the parallel offset contact bridges, said spring cup further includes a separating rib which protrudes outwardly from said surface and between said parallel offset contact bridges when said parallel offset contract bridges are in an inserted condition in said window.

2. The arrangement of claim 1, wherein said spring cup has an outer contour, and said separating rib extends over the entire outer contour.

3. The arrangement of claim 2, wherein said windows have boundary walls, and said boundary walls have recesses, said recesses being adapted to receive said separating ribs.

4. The arrangement of claim 3, wherein said parallel offset contact bridges include contact overlays, wider portions in an area of said contact overlays, with a pair of said parallel offset contact bridges further including matching pairs of extensions and recesses.

5. The arrangement of claim 4, wherein said extensions and recesses are located on one longitudinal side each of said parallel offset contact bridges, and these extensions and recesses are arranged with mirror symmetry relative to the center of said parallel offset contact bridges.

6. The arrangement of claim 1, wherein said windows have boundary walls, and said boundary walls have recesses, said recesses being adapted to receive said separating ribs.

7. The arrangement of claim 1, wherein said parallel offset contact bridges include contact overlays, wider portions in an area of said contact overlays, with a pair of said parallel offset contact bridges further including matching pairs of extensions and recesses.

8. The arrangement of claim 7, wherein said extensions and recesses are located on one longitudinal side each of said parallel offset contact bridges, and these extensions and recesses are arranged with mirror symmetry relative to the center of said parallel offset contact bridges.

* * * * *